US006060824A

United States Patent [19]

Okamoto et al.

[11] Patent Number: 6,060,824

[45] Date of Patent: May 9, 2000

[54] COLOR CATHODE RAY TUBE WITH SPECIFIC PLACEMENT OF MAGNETIC PLATE

[75] Inventors: Hisakazu Okamoto, Kumagaya; Takeki Miyazono, Himeji, both of Japan

[73] Assignee: Kabushiki Kaisha Toshiba, Kawasaki, Japan

[21] Appl. No.: 09/093,407

[22] Filed: Jun. 9, 1998

[30] Foreign Application Priority Data

Jun. 9, 1997 [JP] Japan ..... 9-151209
Sep. 1, 1997 [JP] Japan ..... 9-236041

[51] Int. Cl.[7] ..... H01B 29/70

[52] U.S. Cl. ..... 313/431; 313/430

[58] Field of Search ..... 313/412, 428, 313/430, 431; 335/212, 214

[56] References Cited

U.S. PATENT DOCUMENTS 5,557,164 9/1996 Chen et al. .
5,708,323 1/1998 Okamoto .

FOREIGN PATENT DOCUMENTS

0633598A1 1/1995 European Pat. Off. .
0643413A2 3/1995 European Pat. Off. .

*Primary Examiner*—Vip Patel
*Attorney, Agent, or Firm*—Pillsbury Madison & Sutro LLP

[57] ABSTRACT

A pair of magnetic bodies extending in an axial direction of a color cathode ray tube are arranged apart from each other in a direction perpendicular to the axial direction so as to shield an external magnetic field acting on three electron beams forming a row in the direction perpendicular to the axial direction. A ring-like 6-pole magnet plate disposed in a plane perpendicular to the axial direction is arranged in substantially a central region in a longitudinal direction of the magnetic bodies. These 6-pole magnet plate and magnetic bodies arranged in the particular positional relationship generate a magnetic field distributed to have a plurality of peaks of intensity on the orbit of the central beam. The magnetic field runs on the orbit of the central beam toward one magnetic body around one of the peaks, and runs toward the other magnetic body around the adjacent peak. The cathode is positioned intermediate between the second and third peaks of the magnetic field intensity as counted from the side of a panel. The particular construction makes it possible to decrease the magnetic field component acting on the central beam without decreasing the magnetic field components acting on both side beams. As a result, the central beam is prevented from an undesired moving.

18 Claims, 7 Drawing Sheets

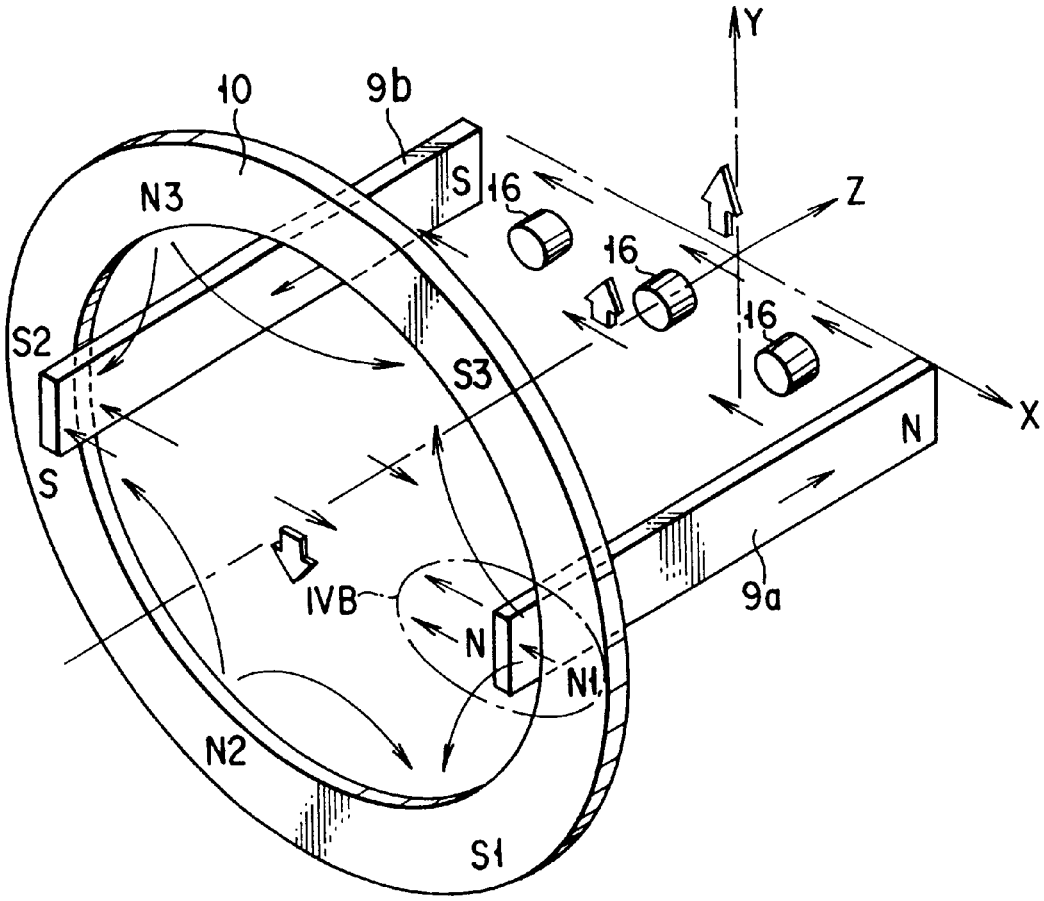
FIG. 4A (PRIOR ART)
FIG. 4B
(PRIOR ART)
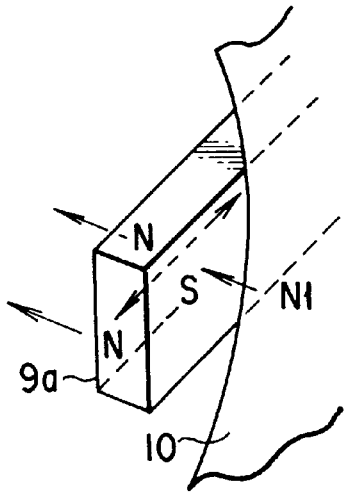

COLOR CATHODE RAY TUBE WITH SPECIFIC PLACEMENT OF MAGNETIC PLATE

BACKGROUND OF THE INVENTION

The present invention relates to a color cathode ray tube, particularly, an in-line type color cathode ray tube equipped with an in-line type electron gun structure and capable of improving the convergence characteristics of a plurality of electron beams emitted from the in-line type electron gun structure.

In general, an in-line type color cathode ray tube comprises an envelope having a panel 1 and a funnel 2 connected to the panel 1, as shown in FIGS. 1 and 2. A phosphor screen 3 emitting red (R), green (G) and blue (B) lights is arranged inside the panel 1. Also, a shadow mask 4 is arranged close to the phosphor screen 3.

The funnel 2 comprises a neck 5 in which are arranged three electron guns forming an in-line type electron gun structure. These electron guns, which emit three electron beams, are arranged to form a row on a horizontal plane, i.e., in a direction of X-axis.

Further, a deflection device 6 is mounted to the outer circumference of a region extending from the funnel 2 to the neck 5. A two-pole magnet 7 having a set of an N-pole and an S-pole arranged to face each other is mounted in a rear end portion of the deflection device 6. The two-pole magnet 7 serves to control the landing of the electron beams.

A convergence magnet 8 is arranged outside the neck 5. The convergence magnet 8 comprises a pair of ring-like magnet plates 11 consisting of two sets of an N-pole and an S-pole arranged to face each other, totaling four poles, and serving to generate a static magnetic field and a pair of ring-like magnet plates 10 consisting of three sets of an N-pole and an S-pole arranged to face each other, totaling six poles, and serving to generate a static magnetic field.

The two-pole magnet 7 and the convergence magnet 8 collectively serve to permit the three electron beams emitted from the electron gun structure, i.e., central beam for green light emission, and two side beams for red and blue light emission, which are aligned to form a single row, to be landed in the center of the phosphor screen 3 so as to achieve a sufficiently high color purity and convergence. These three electron beams are deflected by the deflection device 6 and scanned so as to reproduce a color picture image on the phosphor screen 3.

In the in-line type color cathode ray tube of the construction outlined above, the electron beams are likely to be affected by an external magnetic field such as geomagnetism. Also, the conditions of the external magnetic field are dependent on the direction in which the color cathode ray tube is disposed because it is possible for the color cathode ray tube to be disposed in a direction differing from the direction in which the convergence of the electron beams is adjusted and on the geometrical location of the color cathode ray tube because geomagnetism differs depending on the geometrical location. Such being the situation, it is possible for the red image and blue image displayed on the phosphor screen as a result of excitation with the side beams to be relatively deviated in the vertical direction. The reasons for the generation of the particular phenomenon are considered to be as follows.

Specifically, in the color cathode ray tube disclosed in, for example, Japanese Patent Disclosure (Kokai) No. 7-250335, an electron gun structure is arranged within the neck. In the electron gun structure in this prior art, the cathode which generates thermoelectrons upon when heated by a heater is formed of a material having a low thermal expansion coefficient and acting as a magnetic body. Therefore, if the external static magnetic field generated by, for example, geomagnetism crosses the tube axis in the neck portion, i.e., Z-axis, the external magnetic field is converged toward the cathode, which is a magnetic body, with the result that forces opposite to each other in direction are exerted on the side beams of the aligned three electron beams.

In other words, the external magnetic field causes the side beams to receive forces opposite to each other in the horizontal component, i.e., X-axis component. For example, where an external magnetic field in a positive direction of the X-axis exerts on the electron beam for red emission, force in a negative direction of the Y-axis (vertical direction) is applied to the electron beam so as to cause the electron beam for red emission to be shifted in the negative direction of the Y-axis. On the other hand, an external magnetic field in a negative direction of the X-axis is exerted on the electron beam for blue emission, with the result that force in a positive direction of the Y-axis is applied to the electron beam for blue emission so as to cause the electron beam to be shifted in the positive direction of the Y-axis. It follows that the red image and the blue image displayed on the phosphor screen by the pair of the side beams are deviated from each other in the vertical direction.

Japanese Patent Disclosure No. 7-21938 teaches that, if three electron beams are to be converged, a pair of the side beams are caused to have components opposite to each other in the direction of the X-axis. It is also taught that, where an external magnetic field running in an axial direction of the color cathode ray tube, i.e., Z-axis, is applied to the electron beams under the particular state noted above, the images displayed on the phosphor screen by the side beams are deviated from each other in the vertical direction because of the Lorentz force.

In order to prevent the images displayed on the phosphor screen by the side beams from being deviated from each other, a pair of magnetic bodies 9 serving to shield the external magnetic field running in the axial direction of the tube are arranged as shown in FIG. 2. As shown in the drawing, these magnetic bodies 9 are arranged to extend in the axial direction of the tube on both outer surfaces of the neck 5.

In general, the magnetic body 9 is fixed to the inner surface of a cylindrical holder H in the convergence magnet 8 in a manner to extend in the Z-axis direction as shown in FIG. 2 in order to decrease the number of mounting steps of the magnetic body 9 and to improve the mounting accuracy.

On the other hand, the 6-pole magnet plate 10 has a total of 6 N- and S-poles alternately arranged equidistantly and generates a magnetic field as shown in FIG. 3. The particular distribution of the magnetic field permits force of the same direction to be exerted on the electron beams on both sides so as to change the orbits of the side beams. Also, the magnet plate 10 is designed such that the magnetic field intensity is off-set so as to become substantially zero on the central axis of the color cathode ray tube, i.e., on the orbit of the central beam, with the result that force for changing the orbit does not act on the central beam.

It should be noted that, if the convergence magnet forming a static magnetic field for correcting the orbits of the three electron beams and the magnetic bodies for shielding the external magnetic field are arranged in the neck portion having a limited space, it is unavoidable for the band-like magnetic body and the ring-like magnet plate to cross each other in the neck portion. Where the magnetic body and the magnet plate are arranged close to each other, the magnetic body is magnetized by the action of the magnet plate, particularly, the magnetic poles of the 6-pole magnet plate, giving rise a serious problems as described below.

Specifically, FIGS. 4A and 4B collectively show the distribution of the magnetic field formed by the 6-pole magnet plate and the magnetization of the magnetic body, covering the case where the orbits of the two side beams are corrected vertically upward, i.e., in a positive direction of the Y-axis. In this case, an N-pole and an S-pole of the 6-pole magnetic plate 10 are positioned to face each other, as apparent from FIG. 4A. It is seen that the magnetic bodies 9*a* and 9*b* arranged on the X-axis in a manner to face each other are positioned close to the N-pole N1 and the S-pole S2 of the 6-pole magnetic plate 10, respectively. FIG. 4B shows in a magnified fashion the positional relationship between the magnetic body 9*a* and the 6-pole magnet plate 10.

Since the magnetic body 9*a* is positioned close to the N-pole N1 of the magnet plate 10 as described above, that region of the magnetic body 9*a* which is positioned closest to the N-pole of the magnet plate 10 is magnetized to form an S-pole, i.e., the opposite polarity, as shown in FIG. 4B. This is also the case with the magnetic body 9*b* positioned close to the S-pole S2 of the 6-pole magnetic plate 10. The S-pole formation in, for example, the magnetic body 9*a* noted above causes the entire magnetic body 9*a* to be magnetized such that N-poles are formed at the front and rear end portions.

In short, an S-pole is formed in that surface of the magnetic body 9*a* which faces the N-pole N1 of the magnet plate 10. Also, N-poles are formed at the front and rear edges of the magnetic body 9*a*. Likewise, an N-pole is formed in that surface of the magnetic body 9*b* which faces the S-pole S2 of the magnet plate 10. Also, S-poles are formed at the front and rear edges of the magnetic body 9*b*. As a result, a magnetic field running in the direction of the X-axis from the magnetic body 9*a* to the magnetic body 9*b* is formed at the rear end portions of the magnetic bodies 9*a*, 9*b*. The particular magnetic field exerts an upward force to the electron beams passing through the rear end portions of the magnetic bodies.

It should also be noted that a magnetic flux generated from the N-pole N1 of the magnet plate 10 runs partly through the S-pole formed in the magnetic body 9*a* toward the N-poles at both end portions of the magnetic body 9*a*. Naturally, the magnetic flux component running from the N-pole N1 toward the S-pole S2 of the magnet plate 10 is weakened. As described previously, when the magnetic bodies 9*a*, 9*b* are not disposed, the 6-pole magnet plate 10 is designed such that the magnetic fluxes generated from the N-poles N1, N2, N3 and running toward the S-poles S1, S2, S3 are canceled each other in the central portion of the magnet plate 10. As a result, the magnetic field intensity is substantially zero in the central beam passing point within the magnet plate 10. Where the magnetic bodies 9*a*, 9*b* are disposed as shown in FIG. 4A, 4B, however, the magnetic field generated from the N-pole N1 and running toward the S-pole S2 is weakened as described above. As a result, the magnetic field generated from the N-poles N2 and N3 and running toward the S-poles S1, S3 is relatively intensified. It follows that the central electron beam passing point within the magnet plate 10 is in a magnetic field running in the positive direction of the X-axis, i.e., toward the N-pole N1 of the magnet plate 10. On the other hand, the side beam passing points within the magnet plate 10 are in a magnetic field running in the negative direction of the X-axis, as apparent from the drawing. It follows that the central beam and the side beams are put in magnetic fields running in opposite directions within the magnet plate 10.

As described above, a magnetic field running in the positive direction of the X-axis is exerted on the central beam emitted from a central cathode 16 before the central beam runs to reach the deflection device 6. On the other hand, a magnetic filed running in the negative direction of the X-axis is exerted on the side beams emitted from side cathodes 16 before the side beams run to reach the defection device 6. It follows that the side beams within the magnet plate 10 receive an upward force, i.e., positive direction of the Y-axis, with the central beam within the magnet plate 10 receiving a downward force.

Suppose the 6-pole magnet plate 10 is designed such that, when the magnetic bodies 9*a*, 9*b* are not used, a magnetic field is not exerted on the central beam and, thus, the central beam is not shifted, within the magnet plate 10 and that each of the side beams is upwardly shifted by 1.3 mm within the magnet plate 10 because of the interaction between the electron beam and the magnetic field. In this case, when the magnetic bodies 9*a*, 9*b* are mounted, each of the side beams is shifted upward by 0.5 mm, and the central beam is downwardly shifted by 0.8 mm.

Clearly, the operability of the magnet plate is poor. In addition, since the central beam is shifted in the step of correcting the orbit of the beam by the 6-pole magnet plate 10 after the landing adjustment performed by the two-pole magnet, the central beam must be further controlled again by the two-pole magnet. It follows that the beam control operation is low in efficiency.

As described above, the conventional color cathode ray tube having magnetic bodies mounted therein gives rise to the problem that, when the orbits of the electron beams are corrected in a vertical direction, the shifting amount of the side beam is decreased and, at the same time, the central beam is shifted in an opposite direction.

BRIEF SUMMARY OF THE INVENTION

An object of the present invention, which has been achieved in an attempt to overcome the above-noted problems inherent in the prior art, is to provided a color cathode ray tube having a good operability and excellent in control efficiency.

According to one embodiment of the present invention, there is provided a color cathode ray tube, comprising: an envelope including of a panel having a phosphor screen formed on the inner surface, and a neck connected to the panel via funnel; an electron gun structure arranged inside the neck and including a plurality of cathodes arranged to form a row on a horizontal plane for emitting electron beams toward the phosphor screen; a convergence magnet mounted outside the neck and including at least a magnet plate having six magnetic poles; and a pair of magnetic bodies mounted to face each other with the electron gun structure sandwiched therebetween on the horizontal plane and extending in the axial direction of the color cathode ray tube; wherein the magnet plate is positioned in a central portion of the magnetic bodies in the axial direction of the tube.

Additional objects and advantages of the invention will be set forth in the description which follows, and in part will be obvious from the description, or may be learned by practice of the invention. The object and advantages of the invention may be realized and obtained by means of the instrumentalities and combinations particularly pointed out hereinbefore.

BRIEF DESCRIPTION OF THE SEVERAL VIEWS OF DRAWING

The accompanying drawings, which are incorporated in and constitute a part of the specification, illustrate a presently preferred embodiment of the invention and together with the general description given above and the detailed description of the preferred embodiment given below, serve to explain the principles of the invention.

Figure 1:
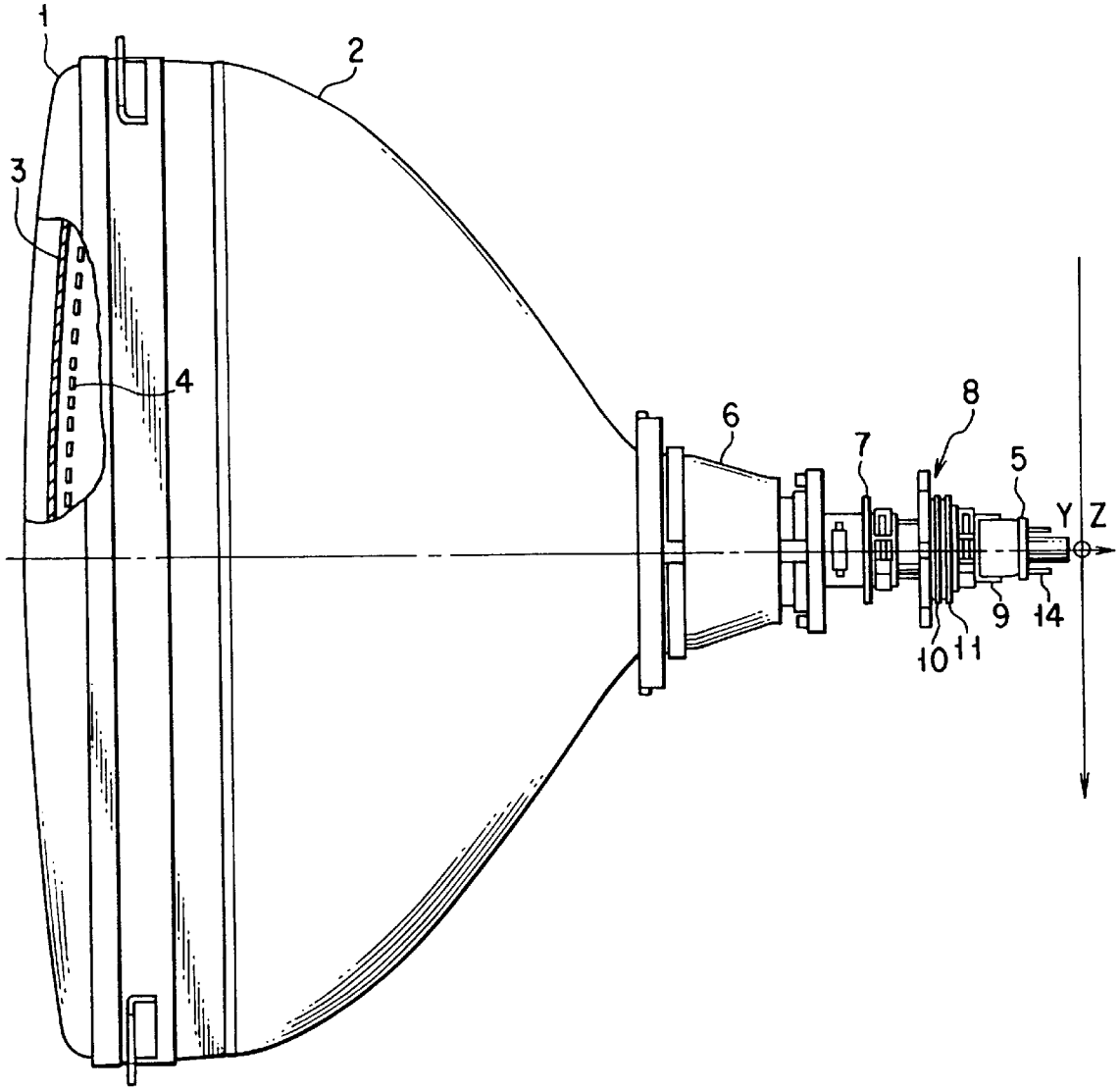
FIG. 1 (PRIOR ART)
FIG. 1 is a side view schematically showing the entire structure of a conventional in-line type color cathode ray tube.
Figure 2:
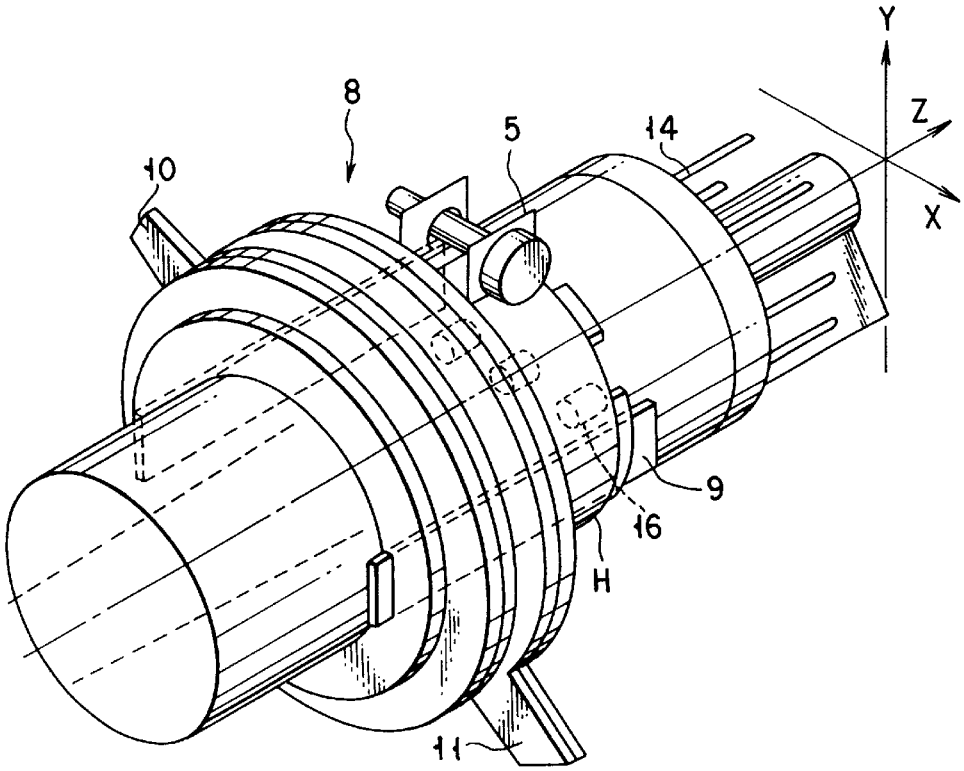
FIG. 2 (PRIOR ART)
FIG. 2 is an oblique view schematically showing a convergence magnet included in the conventional color cathode ray tube shown in FIG. 1.
Figure 3:
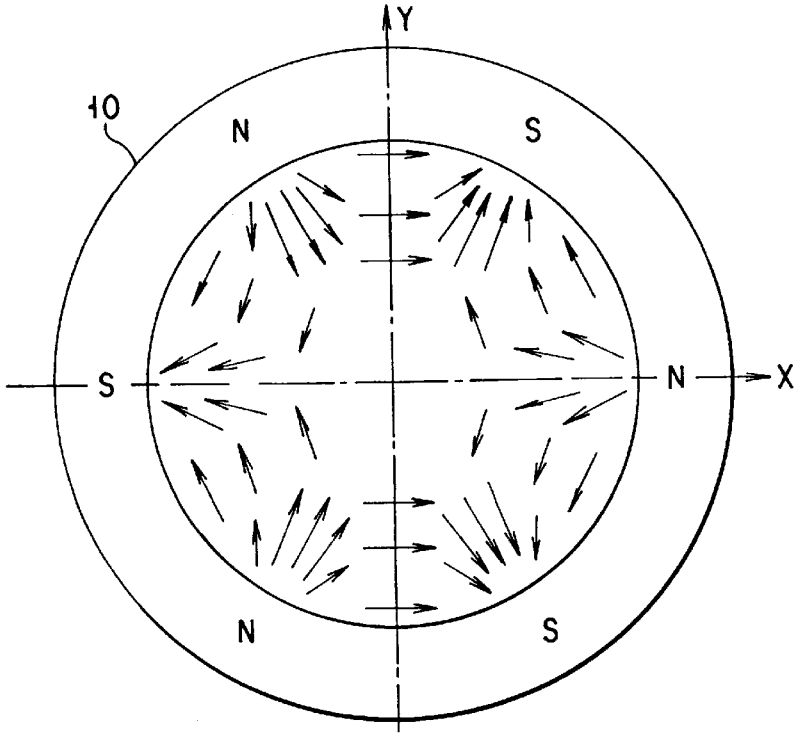
FIG. 3 shows the distribution of the magnetic field formed by a 6-pole magnet plate included in the convergence magnet shown in FIG. 2.
Figure 5:
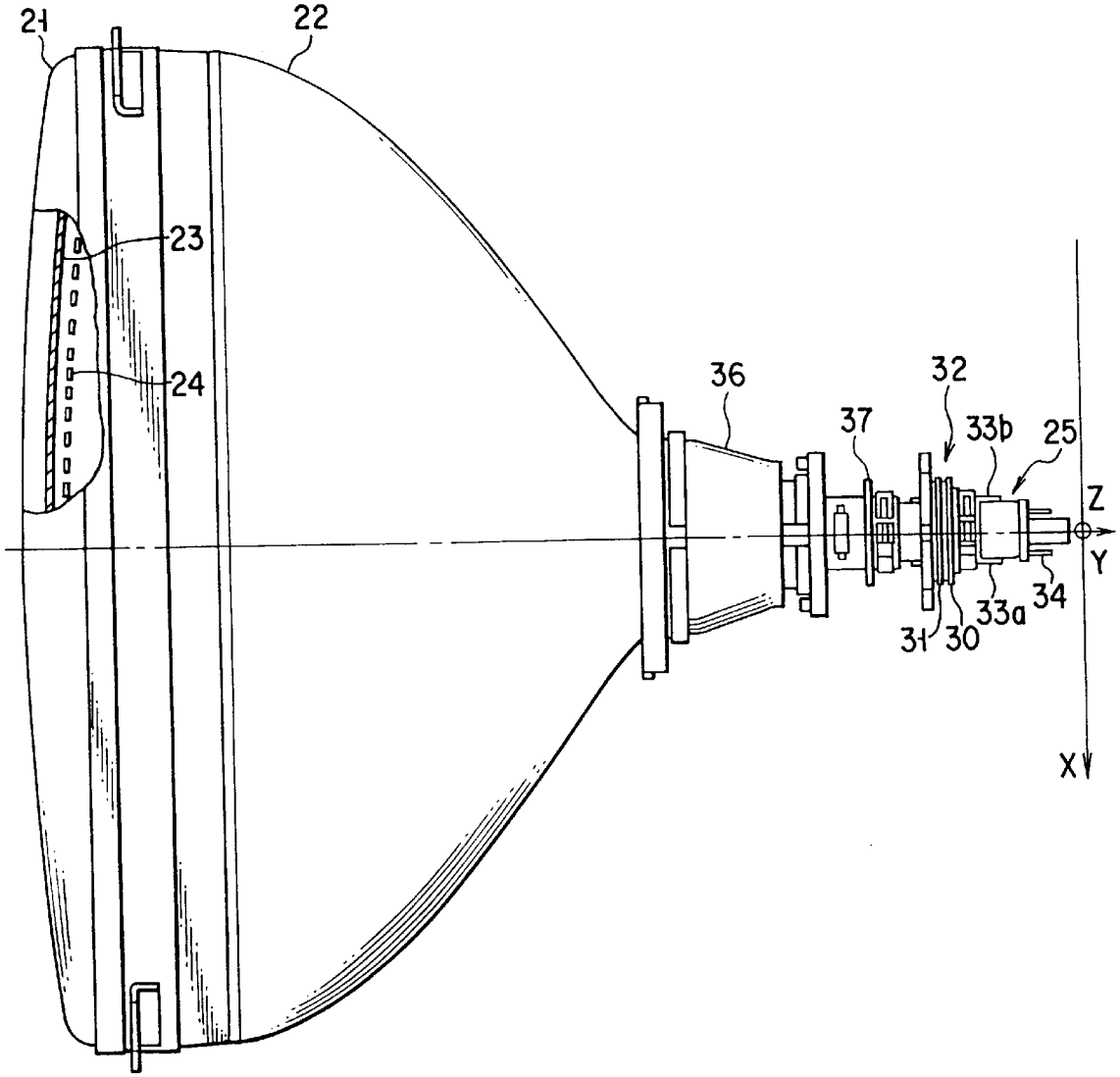
Figure 6:
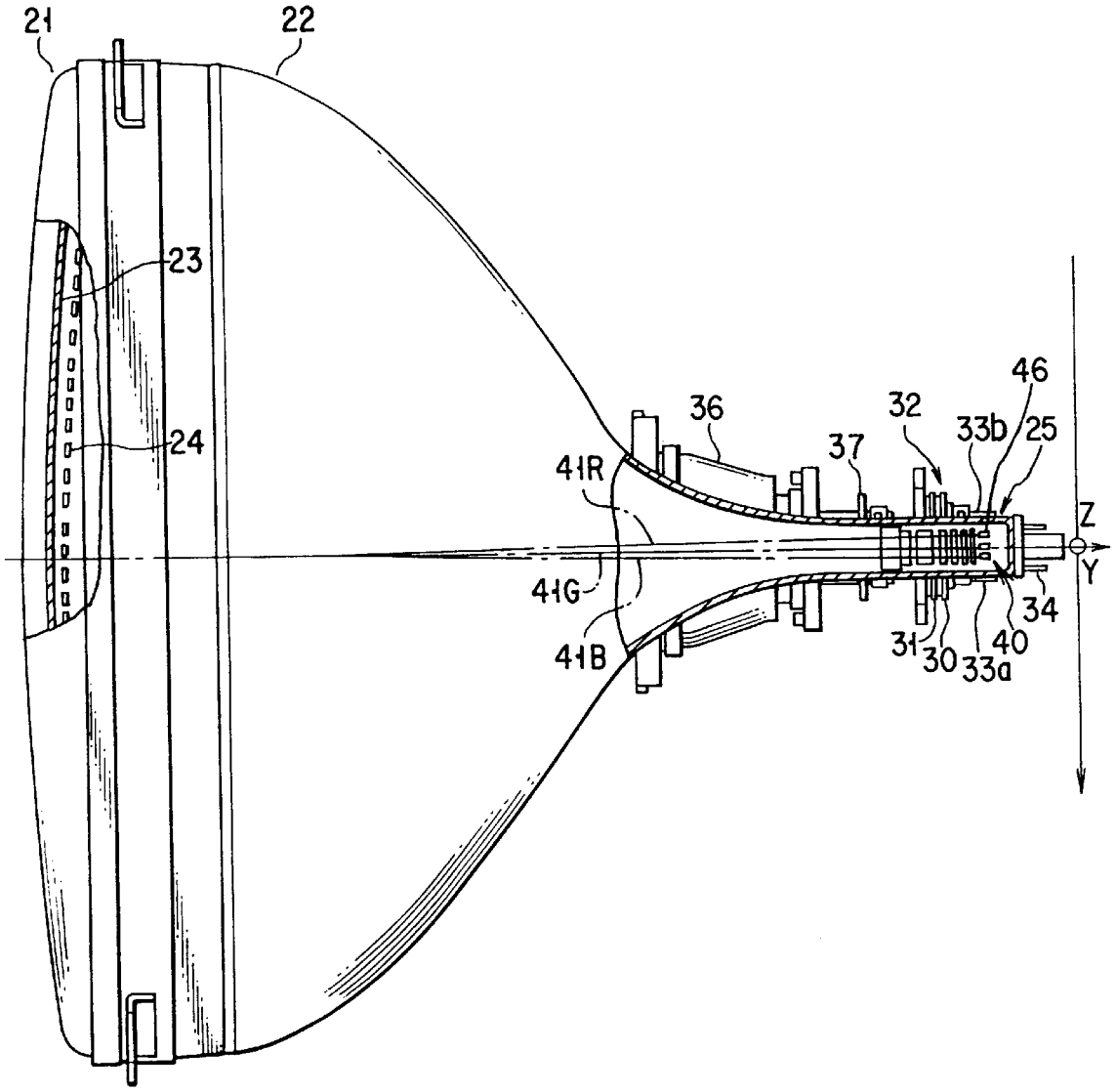
Figure 7:
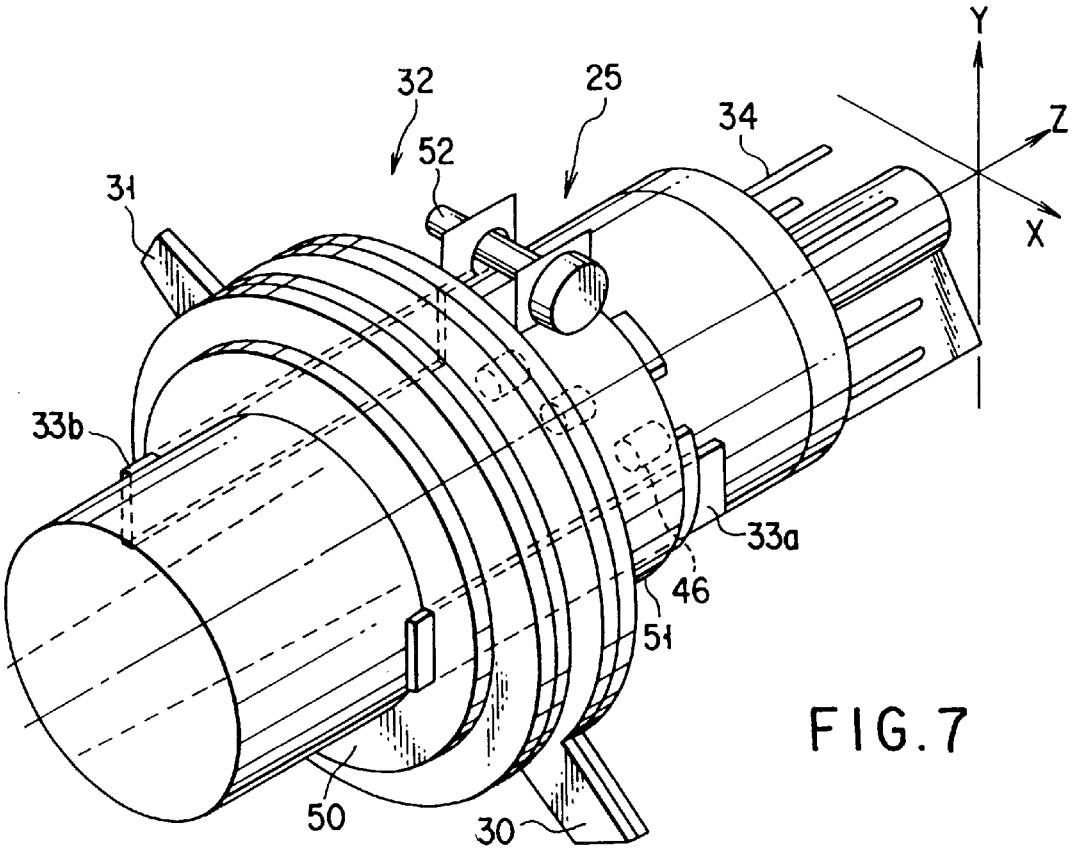
Figure 8:
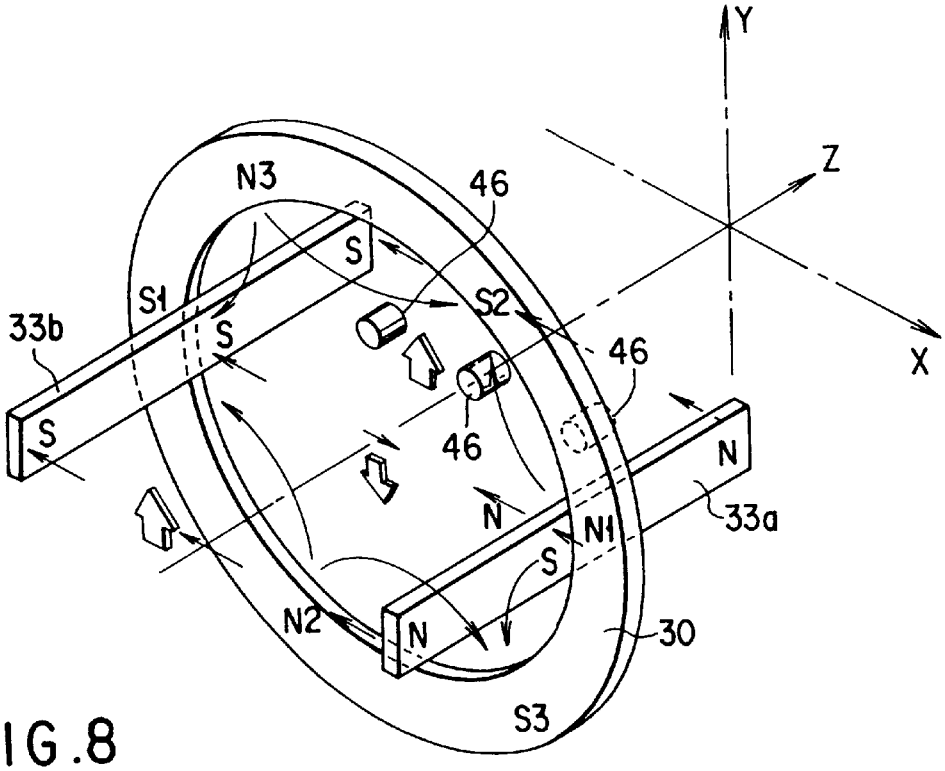
Figure 9:
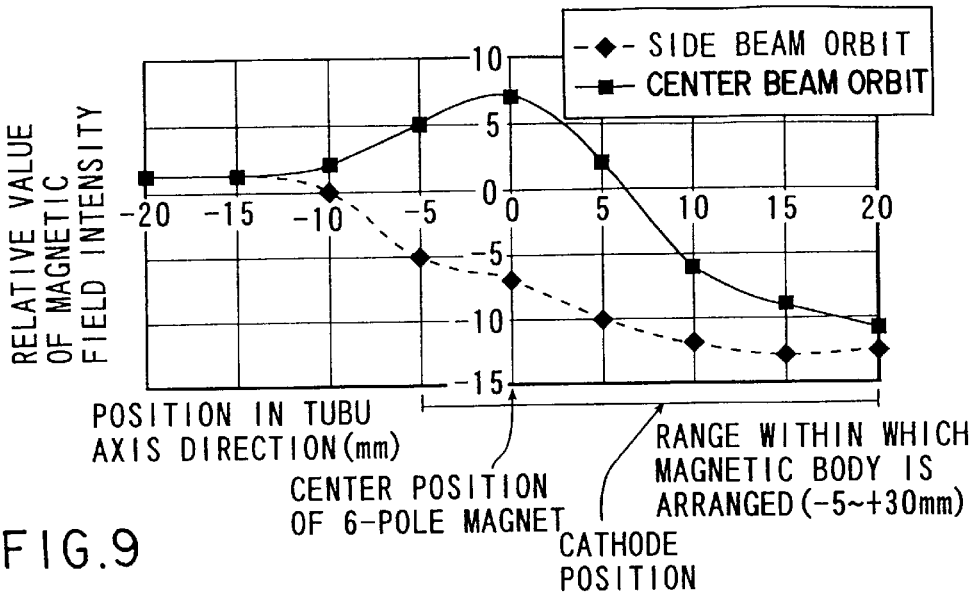
Figure 10:
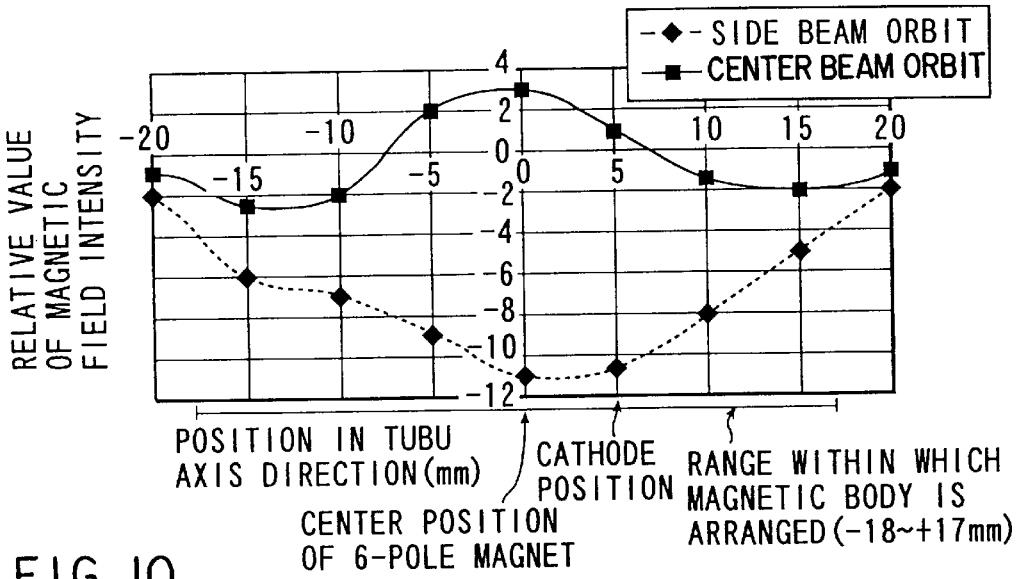
Figure 11:
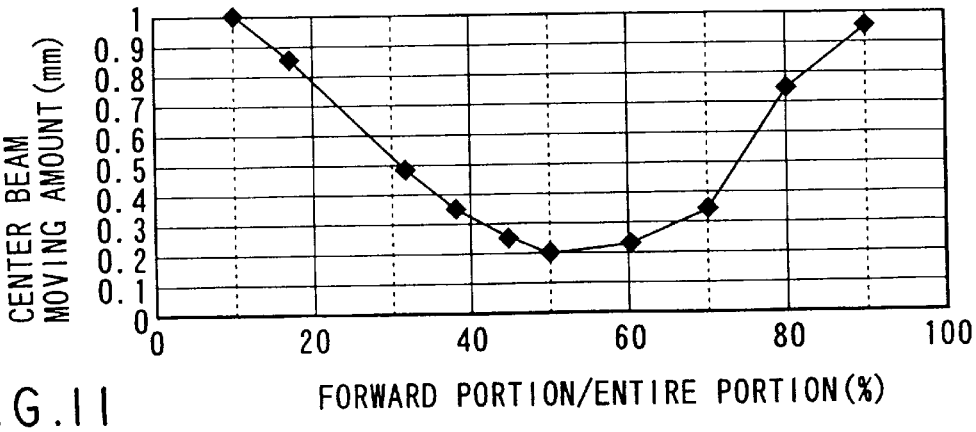

FIGS. 4A and 4B collectively show the positional relationship between the convergence magnet and the magnetic bodies shown in FIG. 2;

FIG. 5 is a side view showing the entire construction of an in-line color cathode ray tube according to one embodiment of the present invention;

FIG. 6 is a cross sectional view, partly broken away, schematically showing the construction of an electron gun structure mounted in the neck of the in-line color cathode ray tube shown in FIG. 5;

FIG. 7 is an oblique view schematically showing the convergence magnet included in the in-line type color cathode ray tube shown in FIG. 5;

FIG. 8 shows the positional relationship between the convergence magnet and the magnetic bodies shown in FIG. 7;

FIG. 9 is a graph showing the distribution on a horizontal plane of the magnetic field intensity on the orbits of the electron beams in the conventional in-line color cathode ray tube;

FIG. 10 is a graph showing the distribution on a horizontal plane of the magnetic field intensity on the orbits of the electron beams in the in-line color cathode ray tube of the present invention; and FIG. 11 is a graph showing the relationship between a ratio in length of the front portion to the entire portion of the magnetic body and the amount of deflection of the central beam.

DETAILED DESCRIPTION OF THE INVENTION

Let us describe in detail a color cathode ray tube of the present invention, particularly, an in-line color cathode ray tube provided with an in-line electron gun structure with reference to the accompanying drawings.

As shown in FIGS. 5 and 6, the in-line color cathode ray tube of the present invention comprises an envelope including a panel 21, a funnel 22 connected to the panel 21, and a neck 25 of a small diameter which is connected to the funnel 22. A phosphor screen 23 consisting of phosphor layers emitting red (R), green (G) and blue (B) lights is formed on the inner surface of the panel 21. Further, a shadow mask 24 provided with a large number of electron beam-passing holes is arranged to face the phosphor screen 23.

An in-line electron gun structure 40 is arranged inside the neck 25 of the envelope. The in-line electron gun structure 40 comprises three cathodes 46 arranged to form a row on a horizontal plane and each having a heater buried therein and a plurality of electrodes arranged in a Z-axis, i.e., arranged apart from each other in axial direction of the tube. The electron beams emitted from these cathodes 46 and running toward the phosphor screen 23 are controlled, focussed and accelerated by these electrodes. These cathodes 46 and electrodes are integrally fixed to an insulating support member. Further, a stem pin 34 serving to supply a predetermined voltage to the in-line electron gun structure is mounted to a rear portion of the neck 25.

A deflection device 36 for forming a nonuniform magnetic field is mounted to the outer circumferential surface of that region of the envelope which extends from the rear end portion of the funnel 22 to the neck 25. The deflection device 36 comprises a pair of saddle type horizontal deflection coils and a pair of saddle type vertical deflection coils. The horizontal deflection coil forms a pin cushion-shaped deflection magnetic field. On the other hand, the vertical deflection coil forms a barrel-shaped deflection magnetic field.

The in-line electron gun structure 40 and the deflection device collectively achieves a so-called "self-convergence" that electron beams 41R (for red emission), 41G (for green emission) and 41B (for blue emission) emitted from the electron gun structure are converged on the phosphor screen 23 formed on the inner surface of the panel 1.

A pair of ring-like 2-pole magnets 37 are arranged outside the neck 25 on side of the rear end portion of the deflection device 36. The 2-pole magnet 37 has a set of an N-pole and an S-pole arranged to face each other. The magnetic field generated by these 2-pole magnets 37 permits the three electron beams to run accurately through beam passing holes made in the shadow mask so as to allow these three electron beams to impinge on the R (red), G (green), B (blue) phosphor dots formed on the phosphor screen 23. In other words, the 2-pole magnets 37 permit the electron beams to land accurately on the phosphor screen. Naturally, the electron beams 41R, 41G and 41B are allowed to impinge on the phosphor dots for the red, green and blue light emission, respectively.

A convergence magnet 32 is arranged intermediate on side of the rear end portion of the 2-pole magnets 37 outside the neck 25. The convergence magnet 32 comprises a pair of ring-like 4-pole magnet plates 31 and a pair of ring-like 6-pole magnet plates 30 The 4-pole magnet plate 31 has two sets of N-pole and S-pole arranged to face each other. The 6-pole magnet plate 30 has three sets of N-pole and S-pole arranged to face each other.

The static magnetic field formed by these 4-pole magnet plate 31 and 6-pole magnet plate 30 permit the orbits of the side beams, i.e., electron beams 41R and 41B, to be controlled appropriately both horizontally and vertically so as to achieve a desired distribution of the three electron beams 41R, 41G and 41B.

As described above, the 2-pole magnet 37 and the convergence magnet 32 serve to permit the three electron beams emitted in the form of a single row from the electron gun structure 40 to impinge on the center of the phosphor screen 23 in a manner to achieve a sufficient color purity and a good convergence when these electron beams are not deflected. These three electron beams are deflected by the deflection device 36 both horizontally, i.e., X-axis direction, and vertically, i.e., Y-axis direction. As a result, the electron beams are scanned on the phosphor screen 23 to form a color picture image on the phosphor screen 23.

In the in-line color cathode ray tube of the construction described above, a pair of band-like magnetic bodies 33*a*,

33*b* are arranged to extend in a Z-axis direction, as shown in FIG. 7, so as to shield the external magnetic field such as the magnetic field produced by the geomagnetism, which adversely affects the electron beams emitted from the electron gun structure. These magnetic bodies 33*a*, 33*b* are arranged to face each other with the neck 25 sandwiched therebetween on the X-axis.

The convergence magnet 32, which comprises a pair of ring-like 4-pole magnet plates 31 and a pair of ring-like 6-pole magnet plates 30 as described previously, is mounted to a cylindrical holder 50 so as to permit the ring-like magnet plates 30 and 31 to be mounted to the neck 25. It should be noted that the intensity of the magnetic field generated from the two magnet plates 30 can be controlled by rotating one of the two magnet plates 30 relative to the other magnet plate 30 on the X-Y plane perpendicular to Z-axis. Likewise, the intensity of the magnetic field generated from the two magnet plates 31 can be controlled by rotating one of the two magnet plates 31 relative to the other magnet plate 31. To be more specific, the 4-pole two magnet plates 31 are arranged such that, if the two handle levers of the two magnet plates 31 are aligned, the N-poles of one of the two magnet plates 31 are positioned to face the S-poles of the other magnet plate 31 so as to make the magnetic field intensity lowest within the free space inside the magnet plates 31. This is also the case with the 6-pole magnet plates 30. On the other hand, the magnetic field intensity is made highest, if one of the 4-pole magnet plates 31 is rotated from the state in which the two handle levers are aligned by 90° relative to the other magnet plate 31. Likewise, the magnetic field intensity is made highest, if one of the 6-pole magnet plates 30 is rotated from the state in which the two handle levers are aligned by 60° relative to the other magnet plate 30.

In the convergence magnet 32, the 6-pole magnet plates 30, the 4-pole magnet plates 31, and a fixing ring are mounted to the cylindrical holder 50 in the order mentioned as viewed from the stem pin 34. It should be noted that a first partition spacer is interposed between the 6-pole magnet plates 30 and the 4-pole magnet plates 31 for mechanically separating these magnet plates 30 and 31 from each other. Likewise, a second partition spacer is interposed between the 4-pole magnet plates 31 and the fixing ring.

The convergence magnet 32 of the particular construction is fixed to the neck 25 by a fastening band 51 and a fastening screw 52 mounted to a proximal end portion of the holder 50.

The magnetic bodies 33*a*, 33*b* are fixed to the inner surface of the cylindrical holder 50 apart from and facing each other in the X-axis direction so as to be mounted on the outer surface of the neck 25. In this embodiment, each of these magnetic bodies 33*a*, 33*b* is made of a cold-rolled silicon steel and sized at, for example, 0.35 mm in thickness, 35 mm in length and 4 mm in width.

Each of these magnetic bodies 33*a*, 33*b* is arranged to cross the 6-pole magnet plate 30 in its central portion. The front edge of the magnetic body is 18 mm away in the negative direction of the Z-axis, i.e., on the side of the deflection device of the tube axis from the center of the 6-pole magnet plate 30. Also, the rear edge of the magnetic body is 17 mm away in the positive direction of the Z-axis, i.e., on the side of the stem pin of the tube axis from the center of the 6-pole magnet plate 30. In the present invention, it is important to divide the magnetic body into a front portion and a rear portion by the center of the 6-pole magnet plate 30. In this case, a ratio in length of the front portion to the entire portion of the magnetic body is about 0.51. In other words, the percentage of the front portion/the entire portion is about 51%.

The cathode 46 of the electron gun structure is positioned about 5 mm away from the center of the 6-pole magnet plate 30 in the positive direction of the Z-axis of the tube.

FIG. 8 shows the positional relationship between the 6-pole magnet plate 30 having N-poles N1, N2, N3 and S-poles S1, S2, S3 and the magnetic bodies 33*a*, 33*b* when the orbits of the two side beams are corrected vertically upward, i.e., in a positive direction of the Y-axis. In this case, the N-pole N1 and the S-pole S1 of the 6-pole magnetic plate 30 are positioned on the X-axis to face each other. As shown in the drawing, these N-pole N1 and S-pole S1 of the magnetic plate 30 are positioned near the central portions the magnetic bodies 33*a* and 33*b*, respectively. As a result, the central portion of the magnetic body 33*a* is magnetized to form an S-pole. Also, the front and rear end portions of the magnetic body 33*a* are magnetized to form N-poles. Likewise, the central portion of the magnetic body 33*b* is magnetized to form an N-pole. Also, the front and rear end portions of the magnetic body 33*b* are magnetized to form S-poles.

What should be noted is that the front and rear end portions of the magnetic bodies 33*a* and 33*b* are magnetized in opposite polarities, with the result that a magnetic field running from the magnetic body 33*a* toward the magnetic body 33*b* is formed in each of the front and rear end portions of the magnetic bodies 33*a*, 33*b*, as shown in the drawing. As a result, upward force is applied to the three electron beams passing through the front and rear end portions of the magnetic bodies 33*a*, 33*b*.

What should also be noted is that the magnetic flux generated from those N-pole N1 and S-pole S1 of the magnet plate 30 runs partly through the magnetic bodies 33*a*, 33*b* so as to weaken a negative magnetic field, which is formed by magnet plate 30, running from +side toward −side on the X-axis around the magnet plate 30.

As described previously, the magnet plate 30 is designed such that the magnetic field intensity becomes zero on the orbit of the central electron beam, when the magnetic bodies are not arranged, because of the interaction of the magnetic fields running from the N-poles toward the S-poles of the magnet plate 30. Where the magnetic bodies are arranged, however, the negative magnetic field running from the N-pole N1 toward the S-pole S1 of the magnet plate 30 is weakened as described previously, with the result that a positive magnetic field, which is formed by the N-poles N2, N3 and the S-poles S2, S3, running from −side toward +side on the X-axis is relatively intensified. It follows that the positive magnetic field running in the positive direction of the X-axis, i.e., toward the magnetic body 33*a*, is generated on the orbit of the central electron beam, though the negative magnetic fields running toward the magnetic body 33*b* are generated on the orbits of the side beams. As a result, a downward force is applied to the central electron beam in the central portion of the magnetic body 33*a* 33*b*, though an upward force is applied to the side beams.

FIG. 9 is a graph showing the distribution of the magnetic field intensity in the horizontal direction on the orbits of three electron beams in the conventional color cathode ray tube. On the other hand, FIG. 10 is a graph showing the distribution of the magnetic field intensity in the horizontal direction on the orbits of three electron beams in the color cathode ray tube of the present invention. In each of FIGS. 9 and 10, a solid line denotes the distribution of the magnetic field intensity on the orbit of the central beam, with a broken line denoting the distribution of the magnetic field intensity on the orbit of the side beams.

In the graph of each of FIGS. 9 and 10, the position in the tube axis direction, i.e., Z-axis direction, is plotted on the abscissa. The zero point of the abscissa denotes the center of the 6-pole magnet plate 30. The negative distance from the zero point in the graph denotes the distance toward the defection device, with the positive distance denoting the distance toward the stem pin. Also, relative values of the magnetic field intensity are plotted on the ordinate of the graph. The positive value of the magnetic field intensity denotes the positive magnetic field running from the magnetic body 33*b* toward the magnetic body 33*a* on the X-axis, with the negative value denoting the negative magnetic field running from the magnetic body 33*a* toward the magnetic body 33*b* on the X-axis.

In the prior art exemplified in FIG. 9, the front edge of the magnetic body is positioned 5 mm away from the zero point toward the deflection device, i.e., −5 mm, with the rear edge being positioned 30 mm away from the zero point toward the stem pin, i.e., +30 mm. It follows that the percentage of the front region/the entire portion of the magnetic body is about 14%. Further, the cathode is positioned 9 mm away from the zero point toward the stem pin, i.e., +9 mm.

In the color cathode ray tube of the present invention exemplified in FIG. 10, the front edge of the magnetic body is positioned 18 mm away from the zero point toward the deflection device, i.e., −18 mm, with the rear edge being positioned 17 mm away from the zero point toward the stem pin, i.e., +17 mm. It follows that the percentage of the front region/the entire portion of the magnetic body is about 51%. Further, the cathode is positioned 5 mm away from the zero point toward the stem pin, i.e., +5 mm.

The sum of the intensities of the magnetic field applied to each of the electron beams corresponds to the integrated value of the curve denoting the distribution of the magnetic field intensity, the curve covering the region between the cathode and the position where the deflecting magnetic field generated from the deflection device 36 is exerted on the electron beam emitted from the cathode. The moving amount of the electron beam in the vertical direction is determined by the integrated value noted above.

In the prior art exemplified in FIG. 9, the magnetic field exerted on the central beam runs toward the magnetic body 33*b*, i.e., negative intensity, in the region between the cathode position (9 mm away from the zero point toward the stem pin, i.e., +9 mm) and the point 6 mm away from the zero point toward the stem pin (+6 mm), but runs toward the magnetic body 33*a* (positive intensity) in the region forward of the point 6 mm away from the zero point noted above (+6 mm) including the front edge 5 mm away from the zero point toward the deflection device (−5 mm). However, since the positive intensity is relatively higher than the negative intensity in the region between the cathode position and the front edge of the magnetic body, a downward force is applied to the central beam.

In general, it is desirable for the moving amount of the central beam to be zero and, thus, it is desirable for the integrated value of the intensities of the magnetic field exerted on the central beam to be zero. It follows that, in this example, it is necessary to decrease the positive intensity of the magnetic field in order to decrease the moving amount of the central beam.

Suppose the 6-pole magnet plate causes the side beam to be moved upward by 1.3 mm while allowing the central beam not to be moved at all when the magnetic bodies are not arranged. When the magnetic bodies are arranged in this case as shown in FIG. 9, the central beam is downwardly moved by 0.8 mm, and the side beam is moved upward by 0.5 mm.

On the other hand, in the example of the present invention shown in FIG. 10, a negative magnetic field running toward the magnetic body 33*b* is generated on each of the rear and front sides of the orbit of the central beam. However, a positive magnetic field running toward the magnetic body 33*a* is generated on the orbit of the central beam in the central portion, i.e., in the vicinity of the 6-pole magnet plate. In short, the 6-pole magnet plate 30 arranged in the central portion in the longitudinal direction of the magnetic bodies 33*a*, 33*b* causes the horizontal component of the intensities of the magnetic field formed by the magnetic bodies and the 6-pole magnet plate to be distributed to form positive and negative peaks so as to form at least three peaks. It should be noted that the cathode 46, which emits an electron beam, is positioned intermediate between the second peak (positive peak) and the third peak (negative peak) of the magnetic field intensity as counted from the side of the deflection device. It follows that the cathode 46 should be arranged at a point where a sum of the positive intensity of the magnetic field exerted on the central beam is substantially equal to a sum of the negative intensity of the magnetic field exerted on the central beam within a section between the cathode position and a point at which the deflecting magnetic field generated from the deflecting device is exerted on the beam.

In the example shown in FIG. 10, the cathode is arranged at a position +5 mm away from the zero point. Naturally, an electron beam is not present from the cathode position to the stem pin position and, thus, the magnetic field formed more than +5 mm away from the zero point is irrelevant to the electron beam move.

If the region more than +5 mm away from the zero point is excluded, the magnetic field intensity on the orbit of the central beam is distributed to have a single positive peak and a single negative peak. These positive and negative peaks are substantially equal to each other in magnitude. As seen from FIG. 10, the magnetic field intensity is positive in a section between the cathode position (+5 mm) and a point −7.5 mm away from the zero point, and is negative in a section less than −7.5 mm away from the zero point. It should be noted that the cathode position is determined to permit a sum of the positive intensities of the magnetic field acting on the orbit of the central beam to be substantially equal to a sum of the negative intensities of the magnetic field acting on the orbit of the central beam. Since the positive and negative intensities of the magnetic field are canceled each other, it is possible to minimize the force acting on the central beam.

On the other hand, the intensity of the magnetic field acting on the side beam is negative as a whole, with the result that the side beam is downwardly moved.

Where the magnetic bodies are not arranged, the magnet plate permits the central beam not to be moved at all and the side beam to be moved upward by 1.3 mm. Where the 6-pole magnet plate is arranged in substantially the central portion in the longitudinal direction of the magnetic bodies as in the embodiment of the present invention, the side beam is upwardly moved by 1.3 mm. On the other hand, the central beam is moved downward by 0.2 mm, clearly supporting that the moving amount of the central beam is improved. In this case, the landing error is 2 $\mu$m, which falls within an allowable range.

As described previously, the percentage in length of the front region/entire region, in respect of the center of the 6-pole magnet plate, of the magnetic body is very important in the present invention. Where the front and rear regions are 12 mm and 23 mm, respectively, the percentage of the front region/entire region being 35%, the side beam was found to have been moved upward by 1.3 mm, with the central beam being moved downward by 0.4 mm. In this case, the landing error can be improved to 4 $\mu$m.

Where the front and rear regions are 10.5 mm and 23.5 mm, respectively, the percentage of the front region/entire region being 30%, the side beam was found to have been moved upward by 1.3 mm, with the central beam being moved downward by 0.5 mm. In this case, the landing error can be improved to 5 $\mu$m.

Further, where the front and rear regions are 23 mm and 13 mm, respectively, the percentage of the front region/entire region being 65%, the side beam was found to have been moved upward by 1.3 mm, with the central beam being moved downward by 0.3 mm. In this case, the landing error can be improved to 3 $\mu$m.

FIG. 11 is a graph showing the relationship between the percentage of the front region/entire region of the magnetic body, which is plotted on the abscissa, and the moving amount of the central beam, which is plotted on the ordinate. As apparent from FIG. 11, it is necessary to arrange the 6-pole magnet plate in a central portion in the longitudinal direction of the magnetic bodies in order to permit the moving amount of the central beam to fall within an allowable range of 0.5 mm or less. To be more specific, the percentage of the front region/entire region of the magnetic body should desirably fall within a range of between 30% and 75%. Preferably, the percentage in question should fall within a range of between 40% and 60% because the moving amount of the central beam can be set at 0.3 mm or less if the percentage falls within the particular range noted above. In other words, it is desirable for the center of the 6-pole magnet plate to be positioned within ±20%, preferably ±10%, in respect of the center in the longitudinal direction of the magnetic bodies.

As described above, the color cathode ray tube of the present invention comprises magnetic bodies mounted to the outer surfaces of the neck portion for shielding an external magnetic field affecting the electron beams emitted from the electron gun structure, and a 6-pole magnet plate serving to control the moving amount of the electron beams. It is desirable for the 6-pole magnet plate to be positioned in substantially a central portion in the longitudinal direction of the magnetic bodies. To be more specific, the percentage in length of the front region/entire region of the magnetic bodies in respect of the center of the 6-pole magnet plate should fall within a range of between 30% and 75%, preferably between 40% and 60%.

It should also be noted that, in the color cathode ray tube of the present invention, the cathodes included in the in-line electron gun structure, which is arranged within the neck portion, are arranged at a position where a sum of the positive intensities of the magnetic field acting on the central beam is substantially equal to a sum of the negative intensities of the magnetic field acting on the central beam within a section between the cathode position and a point at which a deflection magnetic field generated from a deflection device is exerted on the central beam.

As a result, it is possible to suppress the intensity of the magnetic field acting on the central beam without decreasing a sum of the intensities of the magnetic field acting on each of the two side beams. It follows that the side beams can be moved in a vertical direction while substantially preventing the central beam from being moved under the action of the magnetic field.

The particular construction of the present invention described above permits a good operability of the convergence magnet and prevents the central beam from being moved while the 6-pole magnet plate is correcting the orbits of the electron beams after the landing adjustment performed by a 2-pole magnet. It follows that it is unnecessary to allow the 2-pole magnet to adjust again the electron beam landing after correction of the electron beam orbits performed by the 6-pole magnet plate. Clearly, the in-line color cathode ray tube of the present invention is excellent in its control efficiency.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A color cathode ray tube, comprising:

an envelope including a panel having a phosphor screen formed on the inner surface, and a neck connected to the panel via funnel;

an electron gun structure arranged inside the neck and including a plurality of cathodes arranged to form a row on a horizontal plane for emitting electron beams toward the phosphor screen;

a convergence magnet mounted outside the neck and including at least a magnet plate having six magnetic poles; and a pair of magnetic bodies mounted to face each other with the electron gun structure sandwiched therebetween on the horizontal plane and extending in the axial direction of the color cathode ray tube;

wherein the magnet plate is positioned in a central portion of the magnetic bodies in the axial direction of the tube.

2. The color cathode ray tube according to claim 1, wherein the central portion of the magnetic bodies correspond to a region which a ratio in length of a front region to an entire region of the magnetic body in respect the center in a thickness direction of the magnet plate falls within a range of between 30% and 75%.

3. The color cathode ray tube according to claim 1, wherein the central portion of the magnetic bodies correspond to a region which a ratio in length of a front region to an entire region of the magnetic body in respect the center in a thickness direction of the magnet plate falls within a range of between 40% and 60%.

4. The color cathode ray tube according to claim 1, wherein the central portion of the magnetic bodies correspond to a region which the center in a thickness direction of the magnet plate is positioned within ±20% in respect of the center in the longitudinal direction of the magnetic body.

5. The color cathode ray tube according to claim 1, wherein the magnetic bodies are mounted on the outer surface of the neck.

6. The color cathode ray tube according to claim 1, wherein the magnetic bodies are formed integral with the convergence magnet.

7. The color cathode ray tube according to claim 1, wherein:

said convergence magnet comprises a cylindrical holder mounted to said neck, a ring-like first magnet plate having 4 magnetic poles, and a ring-like second magnet plate having 6 magnetic poles; and the magnetic bodies are mounted to the inner surface of said holder.

8. The color cathode ray tube according to claim 1, wherein the electron gun structure is an in-line electron gun structure comprising three cathodes arranged to form a row on the horizontal plane to emit three electron beams, which are also arranged to form a row, and a plurality of electrodes arranged apart from the cathodes on the side of the panel, the electrodes being arranged in the axial direction of the tube.

9. A color cathode ray tube, comprising:

an envelope including a panel having a phosphor screen formed on the inner surface, and a neck connected to the panel via funnel;

an electron gun structure arranged inside the neck and including a plurality of cathodes arranged to form a row on a horizontal plane for emitting three electron beams toward the phosphor screen;

a convergence magnet mounted outside the neck and including at least a magnet plate having six magnetic poles; and a pair of magnetic bodies mounted to face each other with the electron gun structure sandwiched therebetween on the horizontal plane and extending in the axial direction of the color cathode ray tube;

wherein, said pair of magnetic bodies and said magnet plate generate magnetic field, which is distributed such that said magnetic field has a positive component running from one of said magnetic bodies toward an other magnetic body and a negative component running from the other magnetic body toward the one magnetic body on the orbit of the central beam emitted from said electron gun structure; and said cathode is positioned at a point at which a sum of the positive component of the magnetic field on the orbit of the central beam is substantially equal to a sum of the negative component of the magnetic field on the orbit of the central beam.

10. The color cathode ray tube according to claim 9, wherein said magnetic field is distributed on the orbit of the central beam in a manner to have a plurality of positive and negative peaks of intensity occurring alternately, and said cathode is substantially positioned intermediate between the second and third peaks as counted from the panel side.

11. The color cathode ray tube according to claim 10, wherein said cathode is positioned at that point intermediate between the second and third peaks at which the magnetic field intensity is substantially zero.

12. The color cathode ray tube according to claim 10, wherein said magnetic field is distributed such that a sum in intensity of the component including the first peak as counted from the panel side is substantially equal to a sum in intensity of the component including the second peak as counted from the panel side.

13. The color cathode ray tube according to claim 10, wherein said magnetic field is distributed to have three alternate peaks of intensity.

14. The color cathode ray tube according to claim 9, wherein said pair of magnetic bodies are arranged on the outer surface of the neck such that the cathodes included in the electron gun structure arranged inside the neck are interposed between these magnetic bodies.

15. The color cathode ray tube according to claim 9, wherein said pair of magnetic bodies are formed integral with said convergence magnet.

16. The color cathode ray tube according to claim 9, wherein:

said convergence magnet comprises a cylindrical holder mounted to said neck, a ring-like first magnet plate having 4 magnetic poles, and a ring-like second magnet plate having 6 magnetic poles; and said magnetic bodies are mounted to the inner surface of said holder.

17. The color cathode ray tube according to claim 9, wherein said electron gun structure is an in-line electron gun structure comprising three cathodes arranged to form a row on the horizontal plane to emit three electron beams, which are also arranged to form a row, and a plurality of electrodes arranged apart from said cathodes on the side of said panel, said electrodes being arranged in the axial direction of the tube.

18. The color cathode ray tube according to claim 9, wherein said magnet plate is positioned in a central region in a longitudinal direction of said pair of magnetic bodies.

* * * * *